US006104099A

United States Patent [19]

Mizuta et al.

[11] Patent Number: 6,104,099

[45] Date of Patent: Aug. 15, 2000

[54] FOUR-WHEELED ALL-TERRAIN VEHICLE HAVING AN ACCESSORY SOCKET

[75] Inventors: Fumio Mizuta, Akashi; Itsuo Takegami, Kobe, both of Japan

[73] Assignee: Kawasaki Jukogyo Kabushiki Kaisha, Kobe, Japan

[21] Appl. No.: 09/174,559

[22] Filed: Oct. 19, 1998

[30] Foreign Application Priority Data

Nov. 27, 1997 [JP] Japan ..... 9-325804

[51] Int. Cl.[7] ..... H01R 4/00

[52] U.S. Cl. ..... 307/9.1; 439/34; 280/61.54

[58] Field of Search ..... 307/9.1, 10.1, 307/150; 362/258; 296/19; 439/34; 414/426; 280/61.54; 180/233, 54.7

[56] References Cited

U.S. PATENT DOCUMENTS 3,967,133 6/1976 Bokern ..... 307/10.1
4,325,108 4/1982 Spingler ..... 362/258
4,389,066 6/1983 Weir et al. ..... 296/19
5,306,156 4/1994 Gibbs et al. ..... 439/34
5,381,987 1/1995 Carns ..... 414/426

*Primary Examiner*—Albert W. Paladini
*Attorney, Agent, or Firm*—Oliff & Berridge, PLC

[57] ABSTRACT

In a four-wheeled all-terrain vehicle, a handlebar bracket is attached to the upper end of a steering shaft, a handlebar has a central part fastened to the handlebar bracket with clamping members, a bracket is attached to the clamping member, and a handlebar cover is fixedly attached to the bracket so as to cover the central part of the handlebar from above. An accessory socket is disposed inside the handlebar cover and is held on the bracket. An accessory plug electrically connected to an external electric apparatus can be inserted inside the handlebar cover through a recess formed in a side wall of the handlebar cover and can be connected to the accessory socket. A battery is electrically connected to the accessory socket.

6 Claims, 9 Drawing Sheets

FOUR-WHEELED ALL-TERRAIN VEHICLE HAVING AN ACCESSORY SOCKET

BACKGROUND OF THE INVENTION

1. Field of the Invention

The present invention relates to a four-wheeled all-terrain vehicle (hereinafter abbreviated to "ATV") provided with a power supply circuit capable of supplying a dc current from a battery to an external electric apparatus.

2. Description of the Related Art

The ATV is capable of traveling rough terrains including sandy places, rugged lands, rocky mountains and rough lands with muddy puddles. The ATV is provided with a battery for supplying a dc current to a self-starting motor when starting the engine and to a headlight. The battery is used also for supplying a dc current to a dc external electric apparatus, such as a portable lamp, a radio set or an electric winch.

FIG. 10 is a perspective view of a conventional ATV 101, and FIG. 11 is a perspective view of a dc power supply circuit arranged on the ATV 101 to supply power to an external electric apparatus. In FIG. 11, a portable lamp 170 is shown as an example of the external electric apparatus. The ATV 101 is provided with a battery. A wiring harness 163 has a first end connected to the battery, and a second end contained in a front handlebar cover 191 disposed above a front fender B1' and on the front side of a handlebar H' when the same is not used so as to be pulled out of the front handlebar cover 191 when the same is used for supplying power to an external electric apparatus. Another wiring harness 164 for supplying power to an external electric apparatus is stored under a seat S'. An extension wiring harness 165 is connected to the harness 164 to supply power to an external electric apparatus behind the ATV 101. Referring to FIG. 11, two insulated wires 164*a* and 164*b* extending from the second end of the wiring harness 163 are connected to terminals 165*a* and 165*b* connected to the wires 181*a* and 181*b* of a conversion cable 180, respectively. The portable lamp 170 has a power cord 171, and the free end of the power cord 171 is connected to an accessory plug 172. The accessory plug 172 cannot directly be connected to the terminals 165*a* and 165*b*; the same is connected through the conversion cable 180 to the terminals 165*a* and 165*b*. The conversion cable 180 has wires 181*a* and 181*b*. Each of the wires 181*a* and 181*b* has one end connected to a terminal of an accessory socket 182 capable of being electrically connected to the accessory plug 172. The other ends of the wires 181*a* and 181*b* of the conversion cable 180 are connected to terminals 183*a* and 183*b*, respectively. The accessory plug 172 and the accessory socket 182, the terminals 165*a* and 183*a*, and the terminals 165*b* and 183*b* are connected to supply dc power from the battery to the portable lamp 170.

The conversion cable 180 is necessary for supplying power from the battery to an external electric apparatus. Connection of an external electric apparatus to the battery requires troublesome work for pulling out the terminals 165*a* and 165*b* connected to the insulated wires 164*a* and 164*b* of the wiring harness 163 out of the front handlebar cover 191 and for connecting the conversion cable 180 to the wiring harness 163. Although the terminals 165*a* and 165*b* to which the terminals 183*a* and 183*b* of the conversion cable 180 are to be connected are protected by an insulator 195, the insulator 195 is not satisfactorily waterproof because it, is placed outside the front handlebar cover 191. Since many wiring harnesses (not shown) are extended inside the front handlebar cover 191, it is troublesome to discriminate the wiring harness 163 from the rest of the wiring harnesses. The wiring harness 163 pulled out of the front handlebar cover 191 spoils the appearance of the ATV 101.

SUMMARY OF THE INVENTION

Accordingly, it is an object of the present invention to provide an ATV provided with an accessory socket for a dc apparatus, not requiring any conversion cable for connecting the accessory socket to an external electric apparatus, facilitating the connection of an external electric apparatus thereto, and capable of protecting an electrical connection and of avoiding spoiling the appearance of the ATV when an external electric apparatus is connected thereto.

According to one aspect of the present invention, an ATV comprises: a steering shaft having an upper end; a handlebar bracket attached to the upper end of the steering shaft; a handlebar having a central part fastened to the handlebar bracket; a handlebar cover fixedly disposed so as to cover the central part of the handlebar from above and having a side wall provided with a recess; an accessory socket disposed inside the handlebar cover and capable of being connected to an accessory plug electrically connected to an external electric apparatus and inserted inside the handlebar cover through the recess of the handlebar cover; and a battery electrically connected to the accessory socket.

The power supply cable of an external electric apparatus can easily be connected to the accessory socket. Since the accessory socket is disposed inside the handlebar cover, the accessory socket and electrical contacts associated with the accessory socket are protected and the accessory socket does not spoil the appearance of the ATV.

Preferably, insulated wires connected to the accessory socket are connected to those connected to the battery in a space covered with the handlebar cover and the insulated wires connected to the battery are extended along the steering shaft. Thus, the connections between the insulated wires and the accessory socket are protected by the handlebar cover.

The construction of fixing the accessory socket to the ATV can be embodied in various ways. Preferably, the handlebar is fastened to the handlebar bracket with clamping members, a bracket is fixed to the clamping member, and the accessory socket is fixedly inserted in a hole formed in the bracket. Thus, the accessory socket can be attached to the ATV with a simple construction.

Preferably, the handlebar cover is detachably attached to the brackets to facilitate work for the maintenance of the accessory socket and the associated parts.

Preferably, an open end of the accessory socket to be engaged with the accessory plug is covered with a detachable cap. When any external electric apparatus is not connected to the accessory socket, the open end of the accessory socket can be covered with the cap to protect the interior of the accessory socket with a simple operation.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
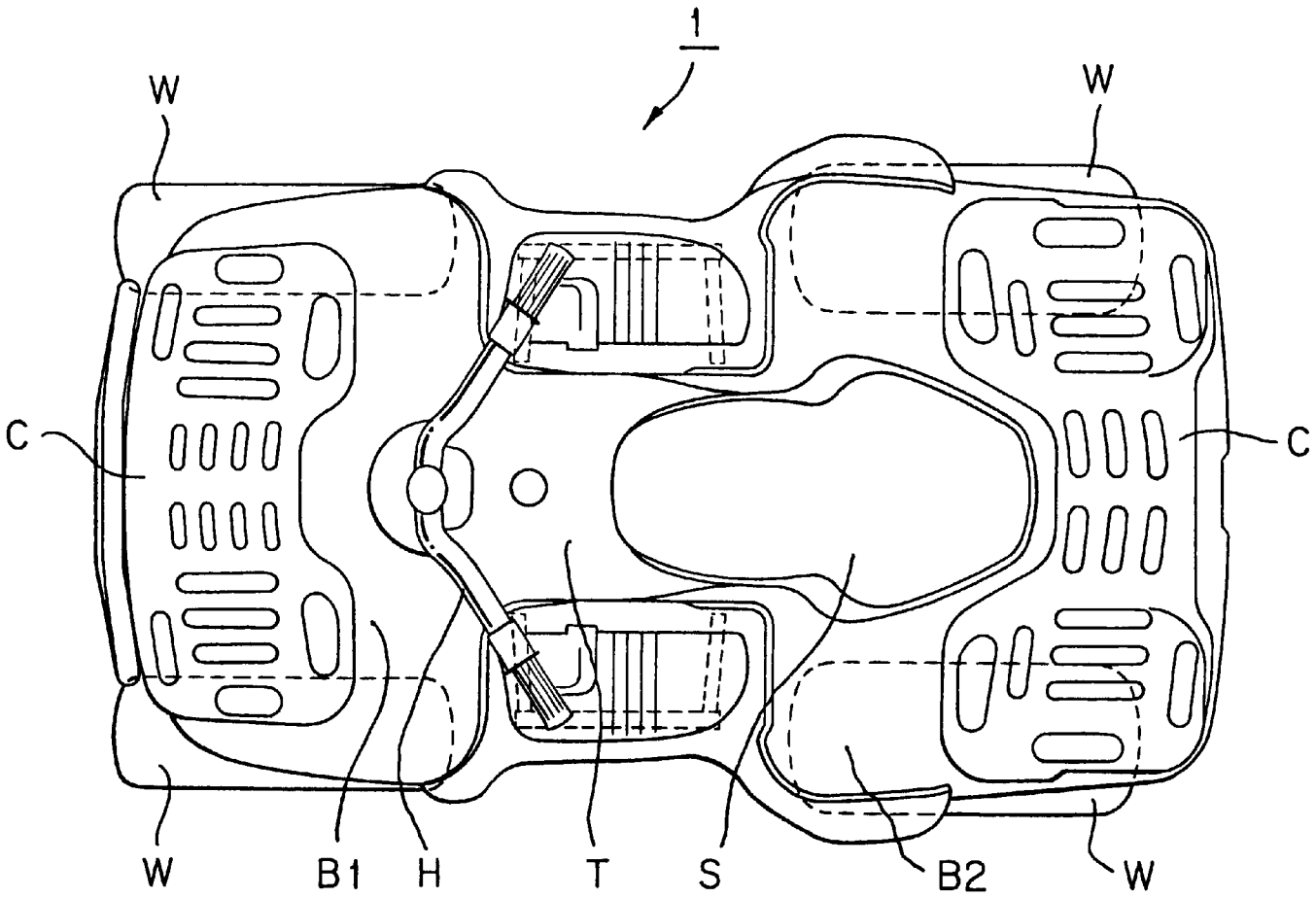
FIG. 1 is a plan view of an ATV in a preferred embodiment according to the present invention.
Figure 2:
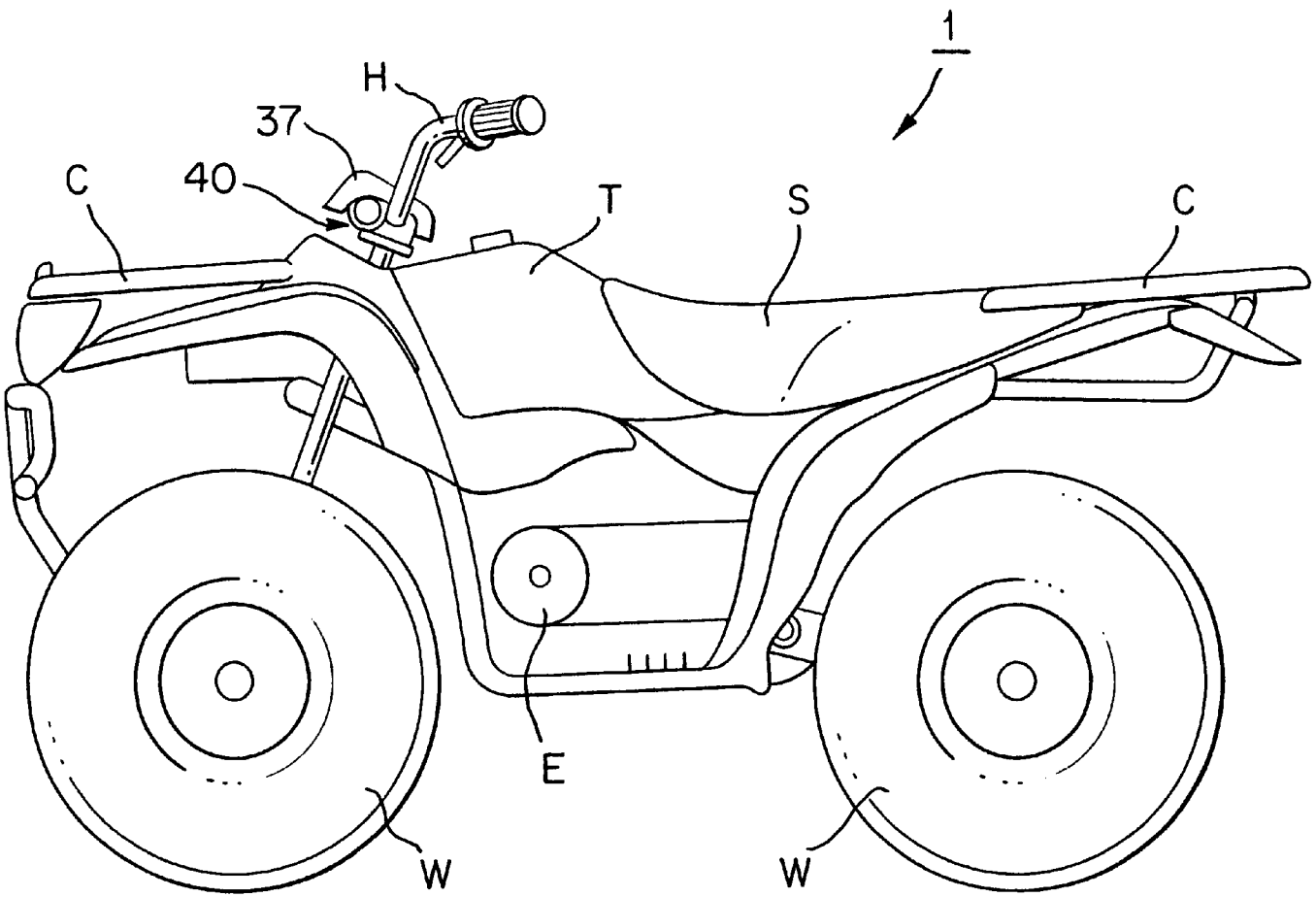
FIG. 2 is a side view of the ATV of FIG. 1.
Figure 3:
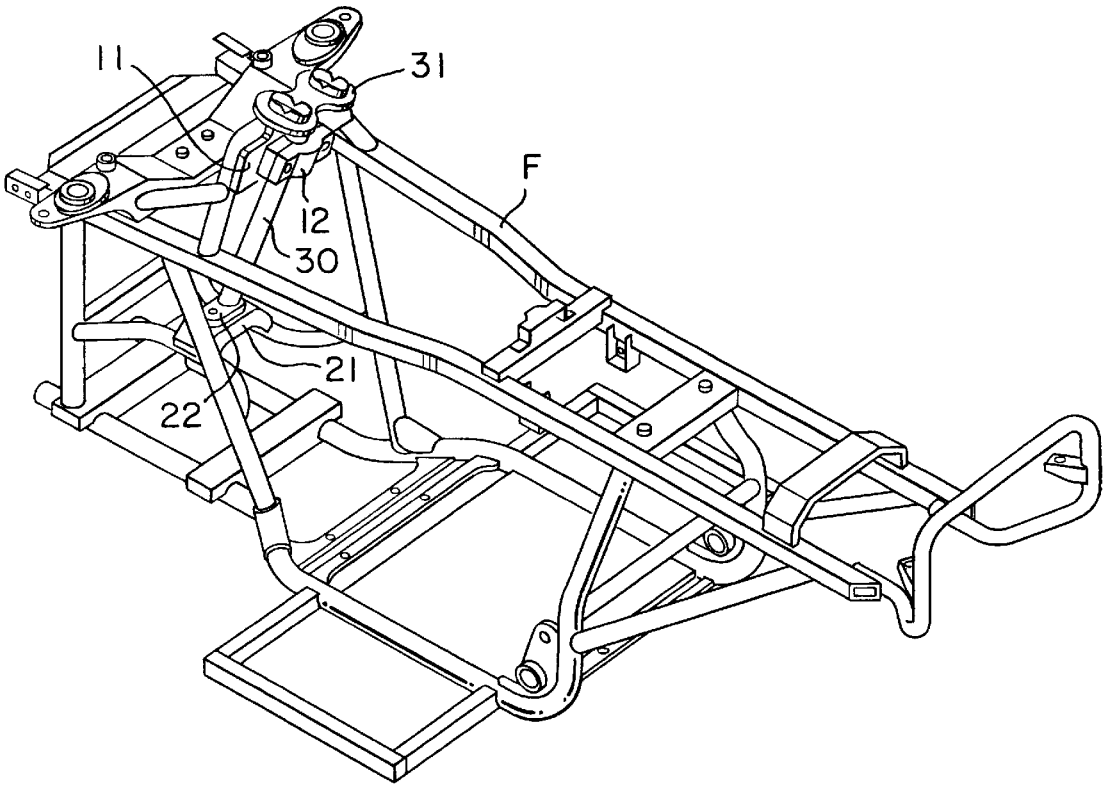
FIG. 3 is a perspective view of a body frame included in the ATV of FIG. 1.

FIG. 1 is a plan view of a four-wheeled ATV 1 in a preferred embodiment according to the present invention, FIG. 2 is a side view of the ATV 1 of FIG. 1, and FIG. 3 is a perspective view of a body frame F included in the ATV 1 of FIG. 1. Referring to FIGS. 1 and 2, a driving system including an engine E, a transmission (not shown) and such, a battery 62 (FIG. 8), a fuel tank T and a seat S are mounted on the body frame F, wheels W are suspended from the body frame F, and a handlebar H is supported on the body frame F. The front wheels W are covered with a front fender B1, and the rear wheels W are covered with a rear fender B2. Baggage carriers C are disposed over the fenders B1 and B2, respectively. As shown in FIG. 3, an upper bracket 11 is fixed to an upper part of a front section of the body frame F, and an upper bearing unit 12 is fixed to the upper bracket 11. A lower bracket 21 is fixed to members of the body frame F in a lower section of the body frame F, and a lower bearing unit 22 is fixed to the lower bracket 21. A steering shaft 30 is supported for rotation on the body frame F by the upper bearing unit 12 and the lower bearing unit 22. A handlebar bracket 31 is fixed to the upper end of the steering shaft 30. The steering shaft 30 is connected by linkages (not shown) to front wheel support mechanisms to change the direction of the front wheels W for steering.

Figure 4:
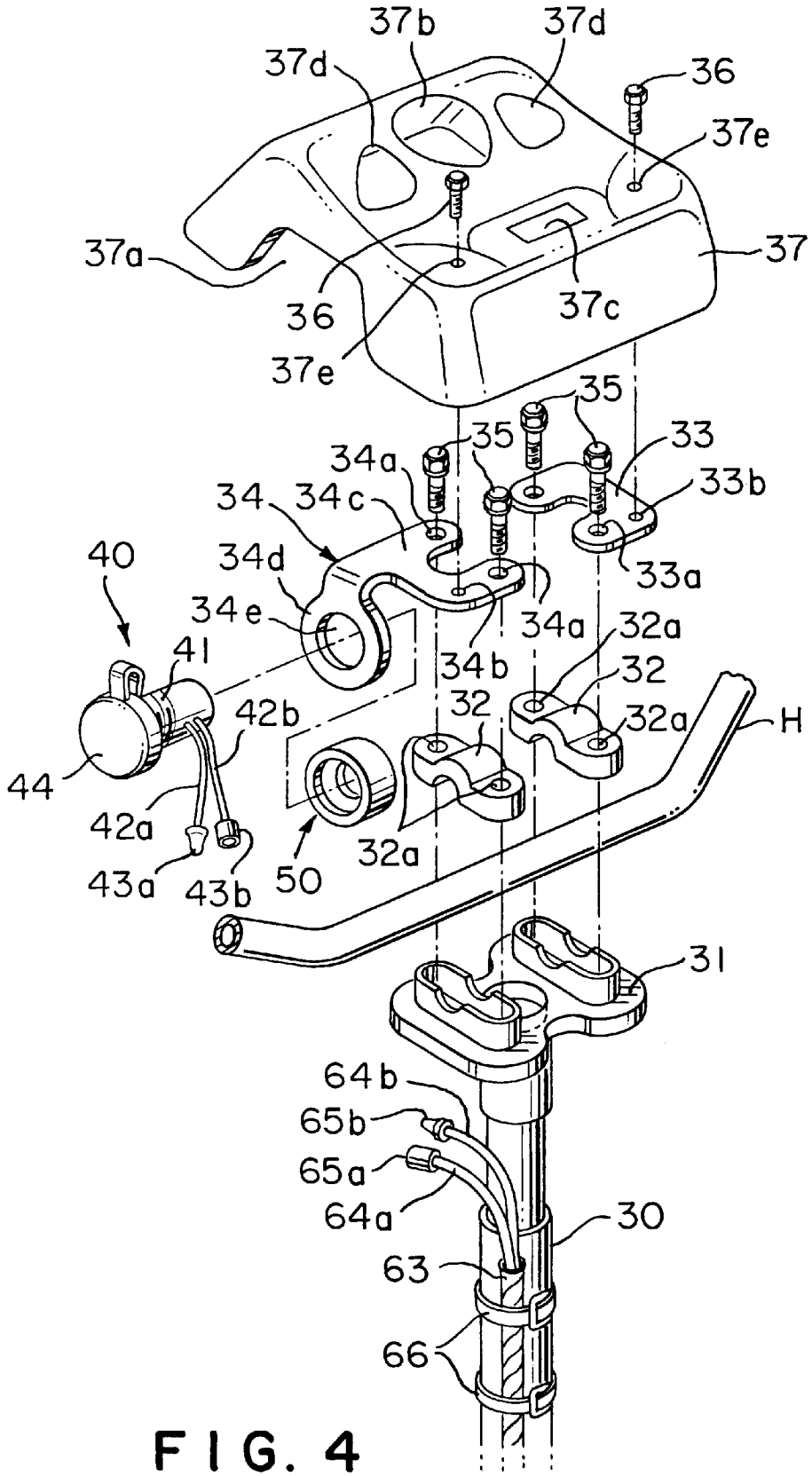
FIG. 4 is an exploded perspective view of an assembly of a handlebar bracket and parts arranged on the handlebar bracket.
Figure 5:
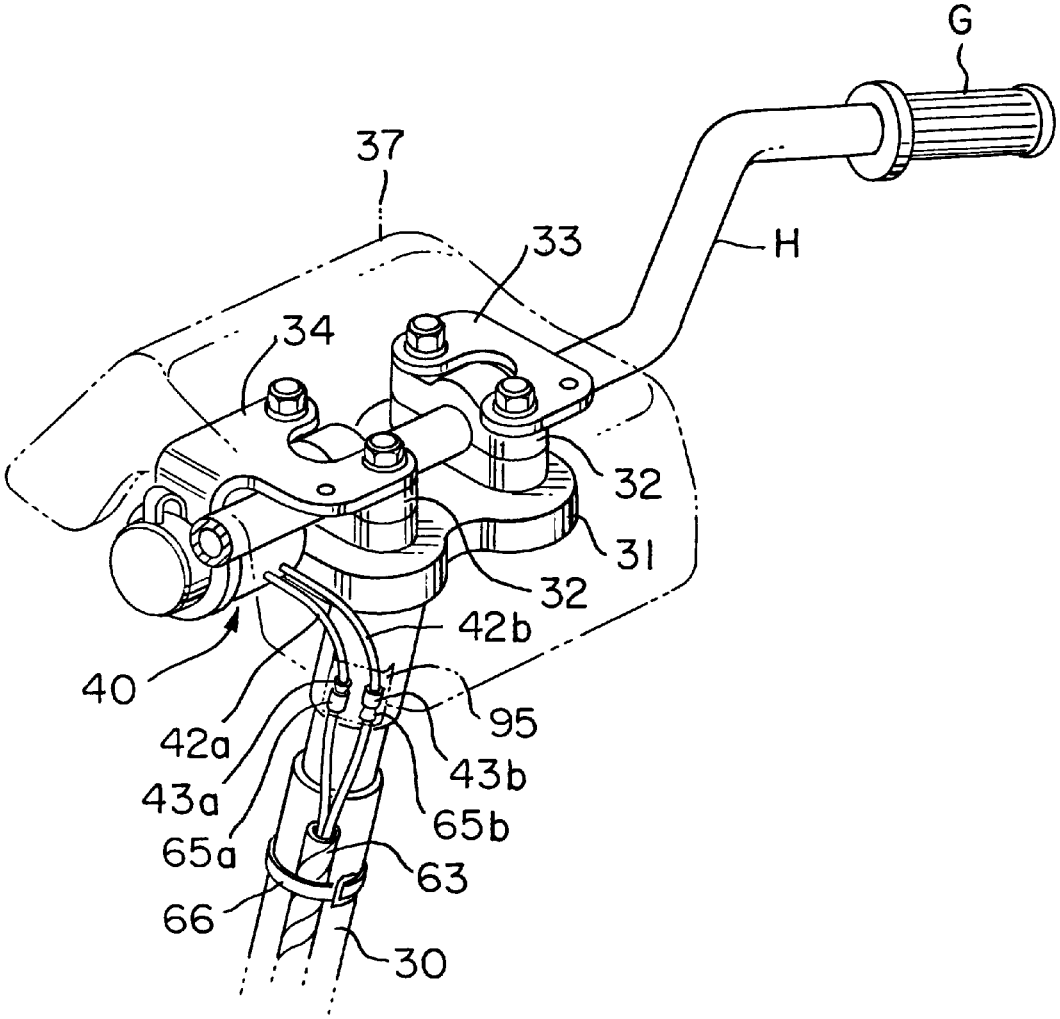
FIG. 5 is a perspective view of the assembly of the handlebar bracket and the parts arranged on the handlebar bracket shown in FIG. 4.

Referring to FIGS. 4 and 5, a handlebar H has a central part fastened to the handlebar bracket 31 with two clamping members 32. Brackets 33 and 34 are placed on the clamping members 32, respectively, and bolts 35 are inserted through holes 33*a* and 34*a* formed in the brackets 33 and 34 in holes 32*a* formed in the clamping members 32 and screwed in threaded holes formed in the handlebar bracket 31 to clamp the handlebar H between the clamping members 32 and the handlebar bracket 31 and to fasten the brackets 33 and 34 to the clamping members 32. Grips G are attached to the right and the left end part of the handlebar H. The right grip G serves as a throttle grip. The right grip G is turned to control the operating speed of the engine E.

The bracket 34 on the left side has a horizontal part 34*c* and a vertical part 34*d* formed integrally with the horizontal part 34*c* and extending vertically downward from the horizontal part 34*c*. A hole 34*e* is formed in the vertical part 34*d*. A single-hole accessory socket 40 having a substantially cylindrical shape and provided with an external screw thread 41 is inserted in the hole 34*e* of the bracket 34, and is fastened to the bracket 34 with a nut 50 screwed on the external screw thread 41 of the accessory socket 40. Insulated wires 42*a* and 42*b* are extended from the accessory socket 40, and terminals 43*a* and 43*b* are attached to the free ends of the insulated wires 42*a* and 42*b*, respectively. The accessory socket 40 is covered with a handlebar cover 37 as shown in FIG. 5. The terminals 43*a* and 43*b* are covered with insulators 95.

A wiring harness 63 is bound to the steering shaft 30 with binders 66. The wiring harness 63 has two insulted wires 64*a* and 64*b* covered with a sheath. An end part of the sheath is removed to expose the insulted wires 64*a* and 64*b*, and terminals 65*a* and 65*b* are attached to the free ends of the insulated wires 64*a* and 64*b*, respectively. The wiring harness 63 is connected to the battery 62 of the ATV 1.

Figure 6:
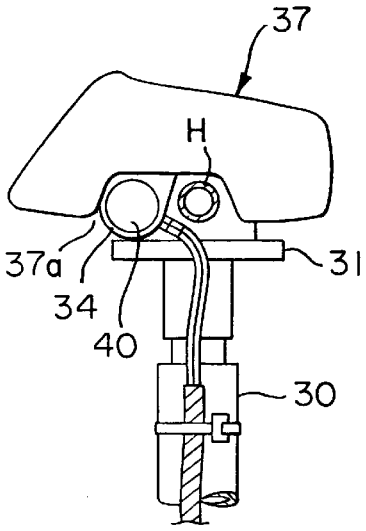
FIG. 6 is a side view of the assembly of the handlebar bracket and the parts arranged on the handlebar bracket shown in FIG. 4.
Figure 7:
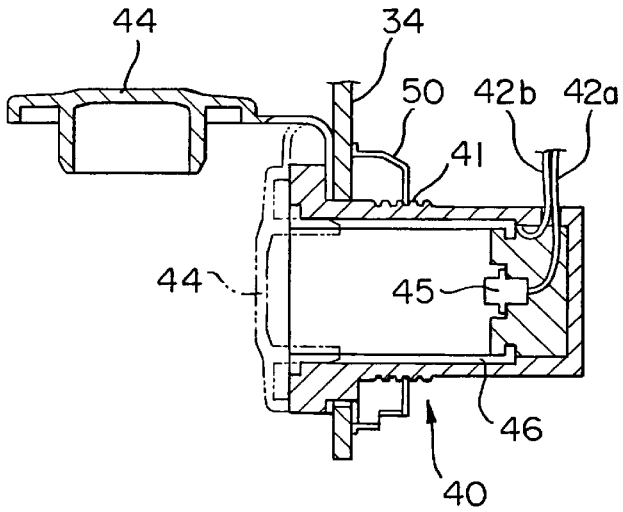
FIG. 7 is a longitudinal sectional view of an accessory socket.

The central part of the handlebar H is covered from above with the handlebar cover 37. Screws are screwed through holes 37*e* formed in the handlebar cover 37 in threaded holes 33*b* and 34*b* formed in the brackets 33 and 34 to fasten the handlebar cover 37 to the brackets 33 and 34. The handlebar cover 37 is provided with an opening 37*b* for a speedometer, an opening 37*c* for shift indicator lamps, and openings 37*d* through which wires including a brake wire are extended. The left side wall of the handlebar cover 37 is provided with a recess 37*a* to expose the front surface of the accessory socket 40, i.e., a surface to be joined to an accessory plug. The accessory socket 40 is provided with a rubber cap 44. When the accessory socket 40 is not in use, the front surface of the accessory socket 40 is covered with the rubber cap 44 to protect the interior of the accessory socket 40 from dust and moisture. It is known from FIG. 6 that the front surface of the accessory socket 40 is exposed through the recess 37*a* of the handlebar cover 37. Referring to FIG. 7, the rubber cap 44 is removed from the front surface of the accessory socket 40. The rubber cap 44 is set at a position indicated by alternate long and taco short dashes lines in FIG. 7 to cover the front surface of the accessory socket 40. The accessory socket 40 is internally provided with two electrodes 45 and 46. The inner ends of the insulated wires 42*a* and 42*b* are connected to the electrodes 45 and 46, respectively, and the insulated wires 45 and 46 extends outside from the accessory socket 40.

Figure 8:
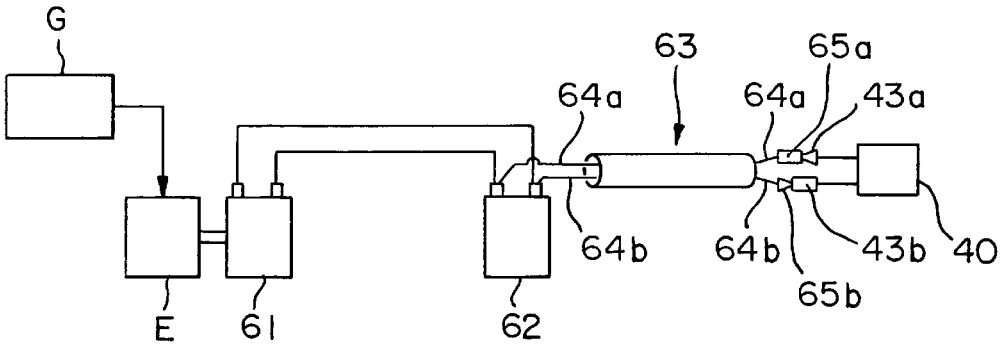
FIG. 8 is a fragmentary diagrammatic view of an electric system of the ATV of FIG. 1.

FIG. 8 shows an electric circuit including a generator 61 driven by the engine E, the battery 62 and the accessory socket 40. The operating speed of the engine E is controlled by turning the right grip G. The output of the generator 61 varies according to the operating speed of the engine E. Power generated by the generator 61 is converted into dc power by a rectifier, the voltage of the dc power is regulated by a voltage regulator to supply dc power of a desired voltage to the battery 62 to charge the battery 62. Power is supplied from the battery 62 to a self-starting motor when starting the engine, and headlights when necessary. In FIG. 8, the self-starting motor, the headlights and wiring connecting the battery to the electrical equipment are omitted. Ends of the insulated wires 64*a* and 64*b* extending from one end of the wiring harness 63 are connected to the terminals of the battery 62, and the terminals 65*a* and 65*b* attached to the other ends of the insulated wires 64*a* and 64*b* are coupled with the terminals 43*a* and 43*b*, respectively, of the accessory socket 40.

As shown in FIG. 5, the terminals 43*a*, 43*b*, 65*a* and 65*b* are covered with the handlebar cover 37, so that the terminals 43*a*, 43*b*, 65*a* and 65*b* can be protected from mud and water splashed by the ATV 1 while the ATV travels a muddy road, and from rain on rainy days by the handlebar cover 37. Since the accessory socket 40 is disposed on substantially the same relatively high level as the handlebar H, the accessory socket 40 is safe from being splashed with mud and water. Since the accessory socket 40 is disposed near the handlebar H, the driver straddled on the seat is able to connect an external electric apparatus to the accessory socket 40 without leaving the seat. The accessory socket 40, the insulated wires 42*a* and 42*b*, and the terminals 43*a* and 43*b* are concealed from view, and the wiring harness 63 need not be pulled out of the handlebar cover 37 when using the accessory socket 40. Accordingly, the appearance of the ATV 1 will not be spoiled by the accessory socket 40. The handlebar cover 37 can readily be removed from the brackets 33 and 34 simply by removing the two screws 36 to expose the accessory socket 40, the terminals 43*a* and 43*b*, and the terminals 65*a* and 65*b* of the wiring harness 63, which facilitates maintenance work.

Figure 9:
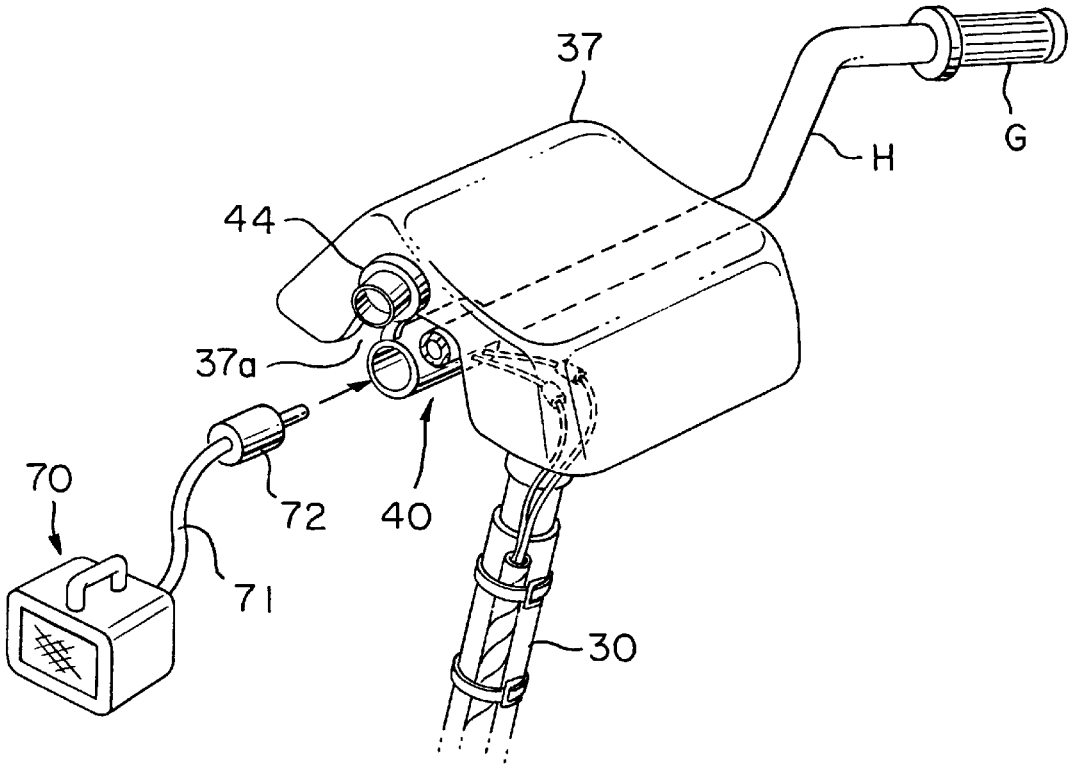
FIG. 9 is a perspective view of assistance in explaining the use of the accessory socket.
Figure 10:
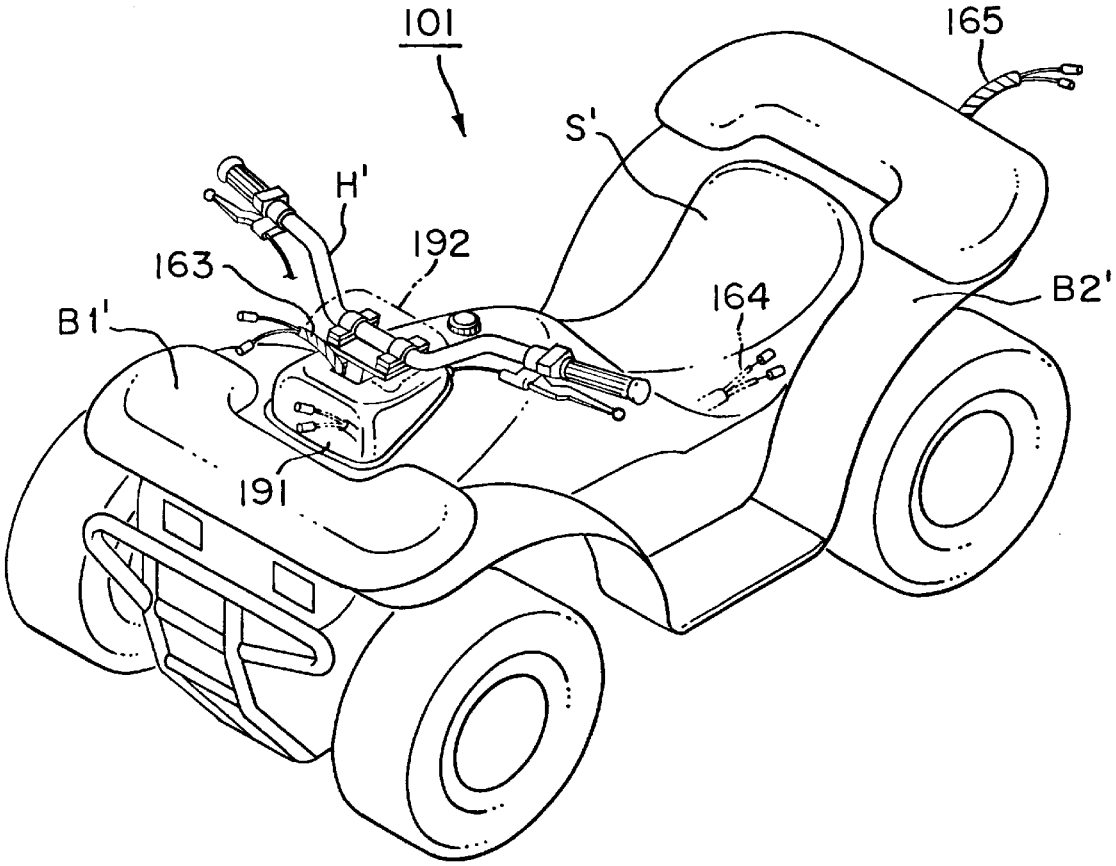
FIG. 10 PRIOR ART
FIG. 10 is a perspective view of a conventional ATV.
Figure 11:
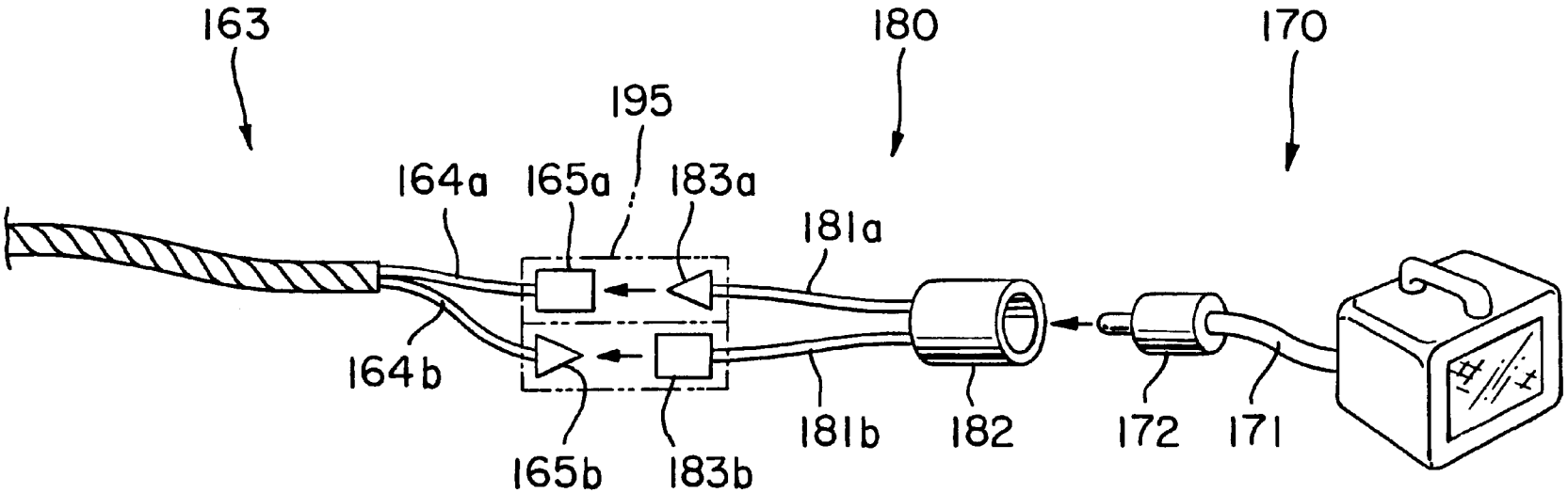
FIG. 11 PRIOR ART
FIG. 11 is a perspective view of a power supply system employed in the conventional ATV of FIG. 10 to supply power to an external electric apparatus.

Referring to FIG. 9, when connecting a portable lamp 70, i.e., an external electric apparatus, to the accessory socket 40, the cap 44 is removed from the front surface of the accessory socket 40, an accessory plug 72 connected to the free end of a power supply cord 71 connected to the portable lamp 70 is plugged in the accessory socket 40 to supply de power to the portable lamp 70.

Although the invention has been described in its preferred embodiment with a certain degree of particularity, obviously many changes and variations are possible therein. It is therefore to be understood that the present invention may be practiced otherwise than as specifically described herein without departing the scope and spirit thereof.

What is claimed is:

1. A power supply device, comprising:

a four-wheeled all-terrain vehicle including a steering shaft having an upper end;

a handlebar bracket attached to the upper end of the steering shaft;

a handlebar having a central part fastened to the handlebar bracket;

a handlebar cover fixedly disposed so as to cover the central part of the handlebar from above and having a side wall provided with a recess;

an accessory socket disposed inside the handlebar cover and capable of being connected to an accessory plug electrically connected to an external electric apparatus and inserted inside the handlebar cover through the recess of the handlebar cover; and a battery electrically connected to the accessory socket.

2. The device according to claim 1, wherein terminals connected to insulated wires connected to the accessory socket are connected to those of insulated wires connected to the battery in a space covered with the handlebar cover.

3. The device according to claim 2, wherein the insulated wires connected to the battery are extended along the steering shaft.

4. The device according to claim 1, wherein the handlebar is fastened to the handlebar bracket with clamping members, a bracket is fixed to the clamping member, and the accessory socket is fixedly inserted in a hole formed in the bracket.

5. The device according to claim 4, wherein the handlebar cover is detachably attached to the bracket.

6. The device according to claim 1, wherein an open end of the accessory socket to be engaged with the accessory plug is covered with a detachable cap to seal the accessory socket.

* * * * *